US006851895B2

(12) United States Patent
Jarry et al.

(10) Patent No.: US 6,851,895 B2
(45) Date of Patent: Feb. 8, 2005

(54) METHODS OF AND APPARATUS FOR MOORING AND FOR CONNECTING LINES TO ARTICLES ON THE SEABED

(75) Inventors: Olivier Jarry, Cormeilles en Parisis (FR); Lionel Storai, Marseilles (FR); Olivier Guitierre, Courbevoie (FR)

(73) Assignee: Stolt Offshore SA (FR)

( * ) Notice: Subject to any disclaimer, the term of this patent is extended or adjusted under 35 U.S.C. 154(b) by 0 days.

(21) Appl. No.: 10/467,774

(22) PCT Filed: Feb. 5, 2002

(86) PCT No.: PCT/EP02/01959

§ 371 (c)(1),
(2), (4) Date: Apr. 8, 2004

(87) PCT Pub. No.: WO02/062653

PCT Pub. Date: Aug. 15, 2002

(65) Prior Publication Data

US 2004/0161302 A1 Aug. 19, 2004

(30) Foreign Application Priority Data

Feb. 7, 2001 (GB) ..... 0104313

(51) Int. Cl.[7] ..... B63B 21/20
(52) U.S. Cl. ..... 405/224; 405/224.1; 114/296
(58) Field of Search ..... 405/224, 224.1; 114/296

(56) References Cited

U.S. PATENT DOCUMENTS 5,704,732 A * 1/1998 Horton, III ..... 405/224
5,992,060 A * 11/1999 Treu et al. ..... 405/224.1
6,113,315 A * 9/2000 Fulton et al. ..... 405/224.1
6,457,908 B1 * 10/2002 Bergeron ..... 405/224
6,554,541 B1 * 4/2003 Antonsen ..... 405/224.1
6,685,396 B1 * 2/2004 Bergeron ..... 405/224
6,719,496 B1 * 4/2004 Von Eberstein ..... 405/224

FOREIGN PATENT DOCUMENTS

| | | |
|---|---|---|
| DE | 123879 | 9/1901 |
| GB | 165042 | 11/1922 |
| GB | 694229 | 7/1953 |
| WO | WO 99/64684 | 12/1999 |
| WO | 99/64684 | * 12/1999 |
| WO | WO 00/56598 | 9/2000 |
| WO | WO 01/32501 | 5/2001 |

* cited by examiner

*Primary Examiner*—Frederick L. Lagman
(74) *Attorney, Agent, or Firm*—Sheridan Ross P.C.

(57) ABSTRACT

There is disclosed improved mooring apparatus and method suitable for use with large offshore vessels. To avoid deploying an anchor with a full weight of mooring chain, they are deployed separately. An anchor, such as a suction anchor (1), is fitted with a short chain (C1) with one end permanently connected (6) thereto and its free end temporarily placed in a chain locator (8), which is positioned so as to be accessible after deployment of the anchor to the seabed, minimising the potential for seabed material to cause disruption. The anchor with its short chain is deployed to the seabed and at some stage the free end of a mooring chain (C2) is lowered to and accurately guided (100) into the chain locator, such that both free ends align. A pin (101) is inserted by an ROV to interconnect the two chains, after which the combined mooring chain (C) is tensioned, withdrawing it from the chain locator.

32 Claims, 6 Drawing Sheets

METHODS OF AND APPARATUS FOR MOORING AND FOR CONNECTING LINES TO ARTICLES ON THE SEABED

This invention relates to methods of and apparatus for connecting lines to articles on the seabed. The primary purpose is to provide a mooring apparatus and a method of mooring suitable for use with large offshore production vessels, such as drilling vessels and production buoys. However, the invention can be applied anywhere where it is desired to attach a heavy tether to an article already deployed on the seabed, for anchoring another article, or for lifting the seabed article itself. The term "tether" will be used to refer to a mooring leg, but also includes a hoisting cable or chain, unless the context requires otherwise.

Offshore production vessels need to be held within a strict geographical area at all times no matter the weather and tidal flow to ensure safe and continuous production and flow of hydrocarbons or gases. In mooring a production vessel a number of anchors are deployed about the production vessel to hold the vessel in position. A typical arrangement for the deployment of these anchors is in a circle centred on the vessel. This type of arrangement means that the loads and forces that will be exerted on the vessel by the sea and climatic conditions can be resisted no matter the direction from which they originate. The present invention may be used to set an array of anchors in the seabed about the vessel. The anchors may comprise simple weights, suction anchors or drag-embedment anchors.

In conventional arrangements the production vessel is held in place by a series of anchors buried in the seabed. This normally means between 8 and 12 anchors equidistantly spaced about the circumference of a circle formed with the vessel at its centre so the production vessel is held in place. Each anchor is at the end of a mooring leg extending from the vessel or buoy to the seabed. The terms "mooring leg" and "main tether" are used to encompass a variety of specific forms of tether, of which heavy chain is the most typical example. Other forms of mooring leg are of course possible, and often comprise sections of chain and sections of cable, connected together according to the properties required at each point along their extent.

Needless to say, the greater the depth of water in which the vessel is deployed the longer the chain and the greater the weight that has to be deployed. In order to deploy and embed the anchor conventional methods involve locating and deploying the anchor with it connected to a mooring leg of the vessel. The anchor is therefore deployed with the full weight of the chain, which forms a part of the mooring leg and connects the anchor to the production vessel. The sheer weight even with the apparent lightening effect of the water becomes burdensome and difficult to operate with. In addition, the vessel to be moored has to be on site when the operation is being carried out, which could be a number of days. Logistically this is inefficient as the vessel is in effect out of service and the operation is more difficult to timetable.

International patent application WO 00/56598 (ANTONSEN) addresses this problem and proposes an apparatus and method for lowering the suction anchor and the anchor chain separately to the ocean bed. The anchor chain is fitted with a special connecting element that is guided by gravity into a special receptacle on the anchor, at the bottom of which is located a locking element. Changing the angle of the connecting element with respect to the receptacle and applying tension to the chain then locks the connecting element within the locking element of the receptacle. However, the bottom of the receptacle and the locking element are positioned so as to be buried when the anchor is installed, and one can envisage that ingress of material could hinder the connecting element from passing through the receptacle to the locking element. Further, the connector after installation carries the full tension of the anchor chain, and must therefore be a massive element, quite apart from the fact that the mass of the mooring chain is attached to it also. Manipulation of this massive element by remotely operated vehicle (ROV) to align the connector and receptacle as it is lowered into the proposed method will be difficult, and may require an unusually powerful ROV. Damage to the ROV may result, as it manoeuvres close to and grasping the heavy chain and connector, apparently still grasping the connector as the latter is lowered from the ship into the receptacle.

Similar problems arise also in sub-sea lifting operations, where it may be desired to recover an article such as an anchor, or some working module used in a construction operation.

The present invention aims to enable a heavy tether to be attached to an article on the seabed in which the above-mentioned problems are overcome or at least significantly reduced. One aim is to enable an improved method of mooring having the benefit of allowing separate installation of the anchors and the mooring line.

In accordance with a first aspect of the present invention, there is provided a method of mooring using at least one anchor, wherein said anchor is first deployed to the seabed and a main tether is subsequently connected to the anchor to form a mooring, the method comprising:

providing the anchor with tether locating means positioned so as to be accessible after deployment of the anchor;

fitting a short first tether section to the anchor so that one end is permanently connected to the anchor and the other end is temporarily located in said tether locating means;

deploying the anchor to the seabed;

lowering to the anchor a free end of said main tether, positioning said free end of said main tether in said tether locating means;

interconnecting said temporarily located end of said first tether section and said free end of said main tether; and lifting said interconnected tether sections clear of said tether locating means.

The method of mooring can be used to moor any large vessel or buoy, particularly in deep water.

The novel method has been developed for the deploying of anchors at great depths and therefore has been developed so that the steps of deploying the anchor and steps subsequent thereto can be carried out remotely, for example with the aid and guidance of an ROV. It is envisaged that the ROV can provide pictures of the operation by cameras mounted thereon and carry out the step of interconnecting the two tethers.

In the novel method the anchors are deployed to and buried in the seabed before they are attached to the mooring leg. Therefore the method may be used to set the anchors in position without the vessel being moored present and in anticipation of the vessel arriving. The steps of deploying and embedding the anchors, and attaching the anchors to the mooring legs may therefore be two independent sets of operational steps and may be carried out by different vessels, a heavy lifting vessel being required only for the second phase, in which the mooring legs are added. The locating means acts as a guide for the main tether, using the weight of that for assistance, to facilitate ROV connection of the two tether sections to complete the mooring leg. Without this facility, an ROV or diver would be unable to manipulate the main tether into position.

Thanks to the provision of the short first tether section, the point of permanent connection to the anchor may be relatively inaccessible, or even buried after deployment, without preventing the connection to the mooring leg. In alternative systems, for example where connection to the anchor is on its top surface, the first tether section might be replaced by a direct connection to a point on the body of the anchor, the locating means may be operable simply to guide the main tether to a point of connection on the anchor body.

The step of positioning said free end of said main tether in said tether locating means may include temporary attachment of a relatively lightweight guide tether between the free end of the main tether and a point on the anchor, the guide tether being dimensioned so that, as the main tether is lowered into position under tension in a predetermined direction, the free end of the main tether correctly locates in the tether locating means under its own weight. The temporarily located end of the first tether section or the free end of the main tether may comprise a shackle.

The temporarily located end of said first tether section and said free end of said main tether may be interconnected by a pin passed through both the shackle and the other of said tether sections.

The anchor may be a suction anchor and the method includes creating a partial vacuum inside the anchor by which it buries itself in the seabed.

In one arrangement of the present invention the first and main tether sections comprise respective lengths of chain.

In accordance with a second aspect of the present invention, there is provided an article or anchor having means for attaching a tether to the anchor, wherein said anchor is further provided with points of attachment for said main tether and at least one guide tether.

The means for attaching said tether may comprise an eye attached to the side of the article or anchor and through which is located a pin or bolt to secure the tether in place.

The anchor may be a suction anchor which buries itself in the seabed by creating a partial vacuum inside the anchor.

The anchor may be further provided with tether locating means for the alignment and temporary location of free ends of different tether sections, said tether locating means being positioned so as to be accessible after deployment of the anchor to the seabed.

The tether locating means may comprise two locating means each comprising a pair of upstands which in combination define a channel, each respectively arranged to accommodate the free ends of said tethers being interconnected and to correctly locate and align said free ends, for subsequent interconnection.

The channel may include a restricted section for locating and orienting a chain link.

The anchor may comprise a vessel having an open bottom end and a closed top end defining a top surface, and said means for attaching the tether to the anchor is on one side of the vessel where it will be buried during deployment of the anchor, wherein the tether locating means is located on said top surface so that the one end is positioned to vertically align with the means for attaching the tether to the anchor.

The tether locating means may be removably fitted to the anchor.

The anchor may include a short tether section with one end fitted to the means for attaching said tether section to the anchor and the other end located in one of the location and alignment means of the tether locating means.

The short tether section may comprise a length of chain.

Others ways for interconnecting two tethers may be used and accommodated in the design of the tether locating means on the anchor.

In accordance with a third aspect of the invention, there is provide a method of connecting a main tether to an article already located on the seabed, the method comprising:

providing the article with points of attachment for said main tether and at least one guide tether;

lowering to the article a free end of said main tether, the free end of said main tether being provided with at least one relatively lightweight guide tether;

attaching said guide tether(s) to the guide tether attachment point(s);

lowering the main tether under tension in a predetermined direction, the guide tether(s) being dimensioned so that, as the main tether is lowered the free end of the main tether correctly locates under its own weight, aligned with said main tether attachment point; and connecting the free end of said main tether to said main tether attachment point.

In a preferred embodiment there are provided two guide tethers attached to respective attachment points spaced horizontally so as to constrain the free end of the main tether to move in a known arc, under a range of tension directions.

The method may include the further preliminary steps of:

providing a tether locating means positioned so as to be accessible after deployment of the article, fitting a short tether section to the article so that one end is permanently connected to the article and a free end is temporarily located in said tether locating means and serves as said main tether attachment point, the method further comprising the step of:

lifting the interconnected main tether and short tether section clear of said tether locating means and into an operational configuration.

The tether locating means and the short tether section may be provided on the article after it is deployed to the seabed. Alternatively, the method may include the further preliminary step of deploying the article to the seabed with the tether locating means and, where provided, the short tether section already attached to the article.

The point of permanent connection of the short tether section to the article may be buried, while its free end remains accessible in said tether locating means.

The invention in a fourth aspect provides an article equipped with main tether attachment points and at least one guide tether attachment point, for use in the connecting method of the third aspect of the invention as set forth.

Other features of the method may be the same as in the mooring methods and apparatus of the first and second aspects of the invention, as set forth above.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1A:
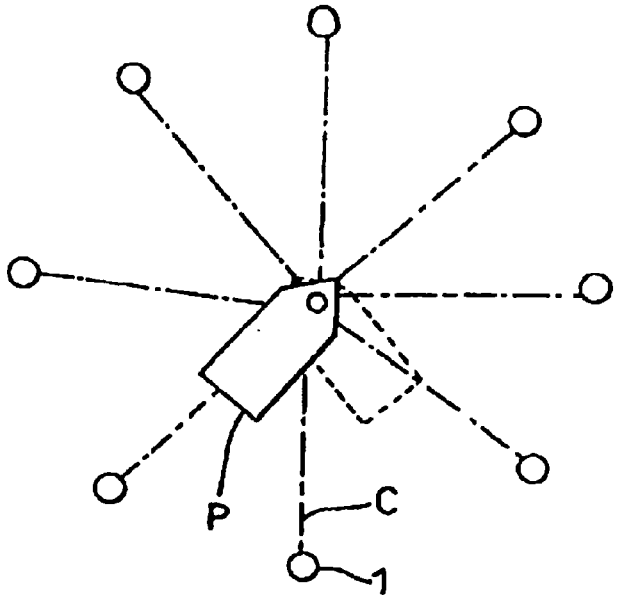
FIG. 1 shows (a) a plan of a production vessel mooring arrangement, and (b) a side view of part of the arrangement.
Figure 1B:
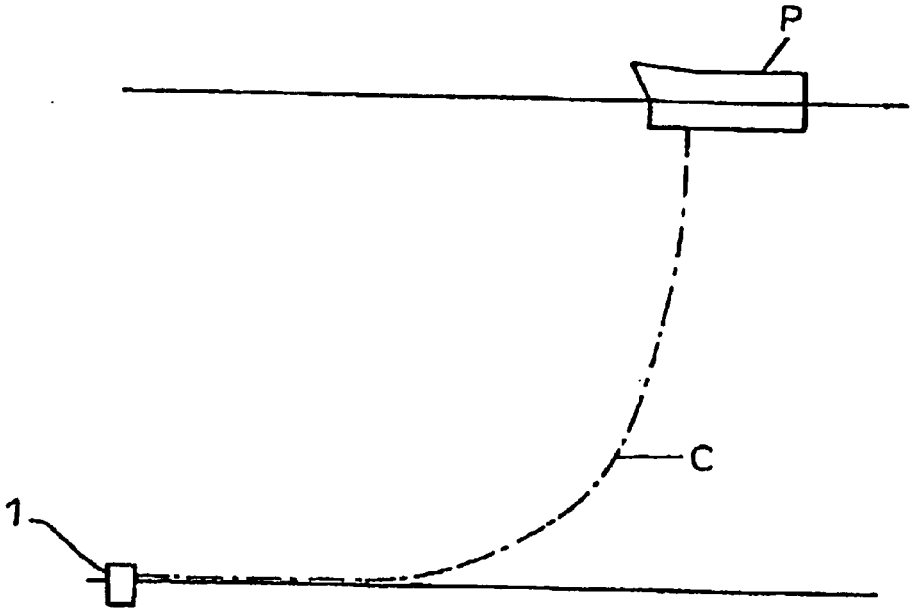

FIG. 1 of the accompanying drawings shows a typical schematic representation of an installation of a floating production vessel P moored in place. The vessel is held in place using 8 (eight) anchors 1 fixed to the vessel P by chains C of respective mooring legs and buried in the seabed so that they are equally spaced around the circumference of a circle centred on the vessel P.

Figure 2:
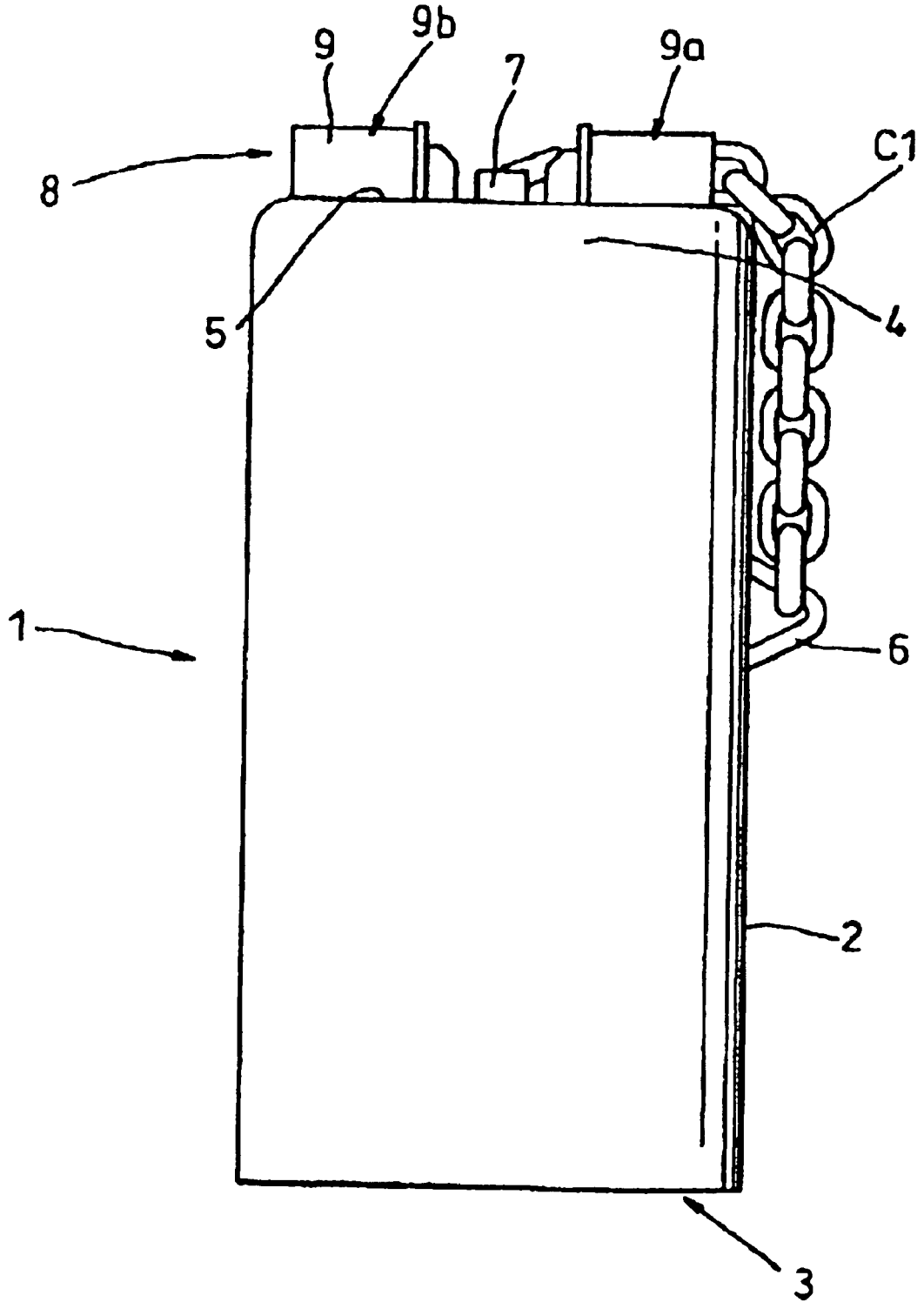
FIG. 2 is a schematic representation of an anchor adapted for use in accordance with one embodiment of the invention.

FIG. 2 of the drawings shows in greater detail a suction anchor 1 suitable for use in the mooring of production vessels and illustrating one aspect of the present invention. The anchor 1 comprises a cylinder 2 open at its lower end 3 and closed at its upper end 4 with a top surface 5. The anchor 1 further includes a pad eye 6; a valve arrangement 7; and chain locating means 8.

The pad eye 6 is mounted to the side of the cylinder approximately one third of the way down, providing means for fixing an anchoring chain to the anchor 1. The exact position of the pad eye 6 on the side of the cylinder 2 depends on the conditions and the working environment of the anchor. In the condition shown in FIG. 2, a short first piece of chain C1 is already attached, as described in more detail below.

The valve arrangement 7 is located on the top surface 5 of the cylinder 2 and is provided to provide suction to assist in the embedding of the anchor 1 into the seabed. In operation the valve arrangement 7 draws air and water trapped inside the cylinder 2 and pumps it clear. Therefore as the anchor 1 is buried in the seabed a build up of pressure from compressed contents of the anchor 1 is avoided and this enables the anchor 1 to be buried to its maximum depth.

Figure 3:
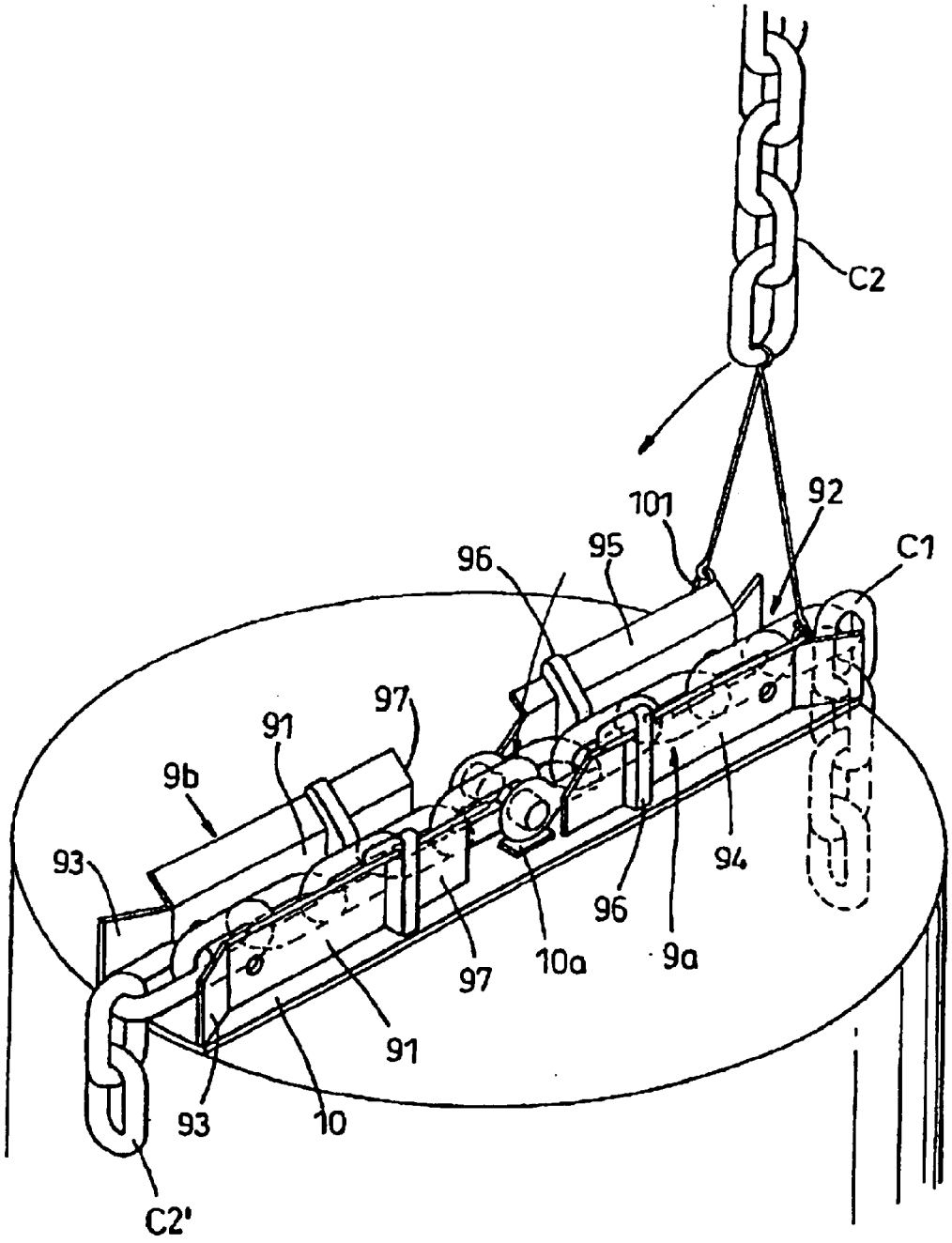
FIG. 3 is an isometric view of the top of the anchor shown in FIG. 2.

In this particular example the chain locating means 8, shown in greater detail in FIG. 3, comprises two chain-guiding funnels 9 located on the top surface 5 of the anchor 1. The funnels 9 are diametrically spaced apart and in combination form an in-line configuration across the top surface 5 with one end of each funnel 9 located adjacent the edge of the top surface 5 and the other end towards the centre. The end of one of the funnels 9 is located directly above the pad eye 6.

The funnels 9 are mounted to a plate 10 that can be fixed either permanently or removably fitted to the top surface 5. Two pads 10*a* are provided in the space between the two funnels 9 on the plate 10.

Each funnel 9 comprises two substantially parallel side walls 91 so that in combination the two funnels 9 form a channel 92 therethrough and therebetween. The side walls 91 each have a lower substantially vertical, with respect to the top surface 5, section 94 which defines the channel 92 and upper sloped sections 95 to help guide a chain into the channel 92. Guide walls 93 are provided at the end of the side walls 91 adjacent the edge of the top surface 5, and are mounted on the plate 10 in an outwardly pointing configuration to further provide guidance into the channel 92. At the other end of each side wall 91 is a chamfered end plate 96 so that the two end plates 96 of each funnel 8 provide a restricted section to the channel 92 with the chamfering again acting to guide the anchor into the channel 92. A centre plate 97 is provided on the other side of each of the end plates 96.

In use the chain locating means 8 is provided to better enable the connection of one chain to a second chain remotely and in harsh environments, such as at great depths in the ocean. In the particular example illustrated one of the funnels 9*a* is for locating a shackle on the end of a first chain and the other funnel 9*b* is for locating of one end of a second chain. Therefore, whilst the two funnels 9 are substantially identical to each other there are engineering differences. This is in the shaping of the centre walls 97, and specifically the funnel 9*a* for locating of a shackle, has the end of the centre walls 97 nearer the centre of top surface 5 cut away. This better enables the passage of the shackle into position in the channel 92. In the example shown the funnel 9*a* has one of its ends located directly above the pad eye 6.

FIG. 3 shows the anchor with a chain C2 from a mooring leg being lowered, and at C2' with the chain further lowered into position by using a guide hook and wire 100 between the end of the chain and eyelets 101 mounted upon funnel 9*a*. Chains C2 and C1 are then interconnected, the following paragraphs describing the method by which this is achieved.

Prior to the deployment of the anchor 1 to the seabed a small length of chain C1, is prefitted to the anchor. This can be carried out either at the factory or aboard the vessel. In fitting of this chain C1 one end is fitted to the pad eye 6 and then the end of the chain having a shackle is lifted and lowered into position in the funnel 9*a*. The chain C1 is correctly located in the funnel 9*a* when the fixing eyes on the shackle rest on the pads 10*a* and the link directly behind this is vertically located between the chamfered end plates 96. No other means is used to hold the chain C1 in position on the anchor.

The anchor 1 is now ready for deployment to the seabed and the method of doing this is as with a conventional anchor except that the bulk of the mooring chain is not as yet connected to the anchor.

Figure 4:
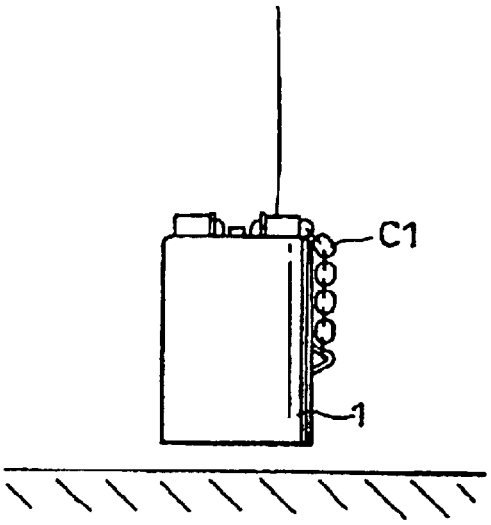
FIGS. 4 to 8 shows the operation of deploying and interconnecting the anchor.
Figure 5:
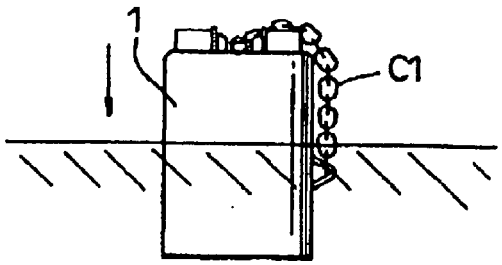

The deployment of the anchor 1 and the attachment to a mooring leg is shown at various stages in the operation in FIGS. 4 to 7 of the drawings. FIG. 4 shows the anchor 1 being lowered to the seabed. At the seabed the anchor 1 is positioned and when resting on the seabed the valve arrangement 7 activated. As the air and water trapped in anchor 1 are pumped out the anchor is drawn into the seabed until fully deployed (see FIG. 5). Throughout these operations the chain C1 remains located in the funnel 9*a*.

Figure 6:
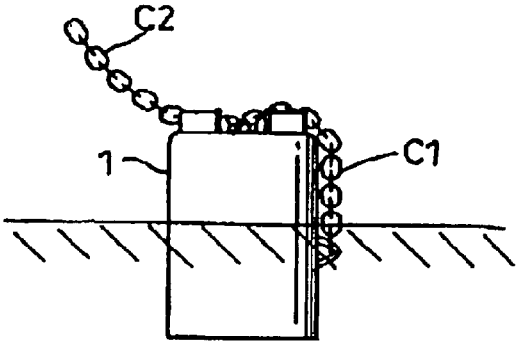
Figure 7:
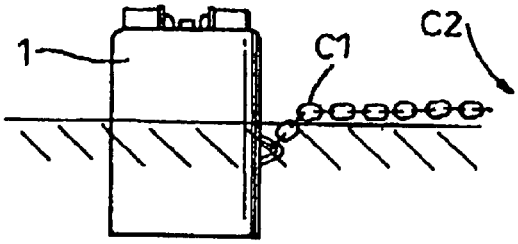
Figure 8:
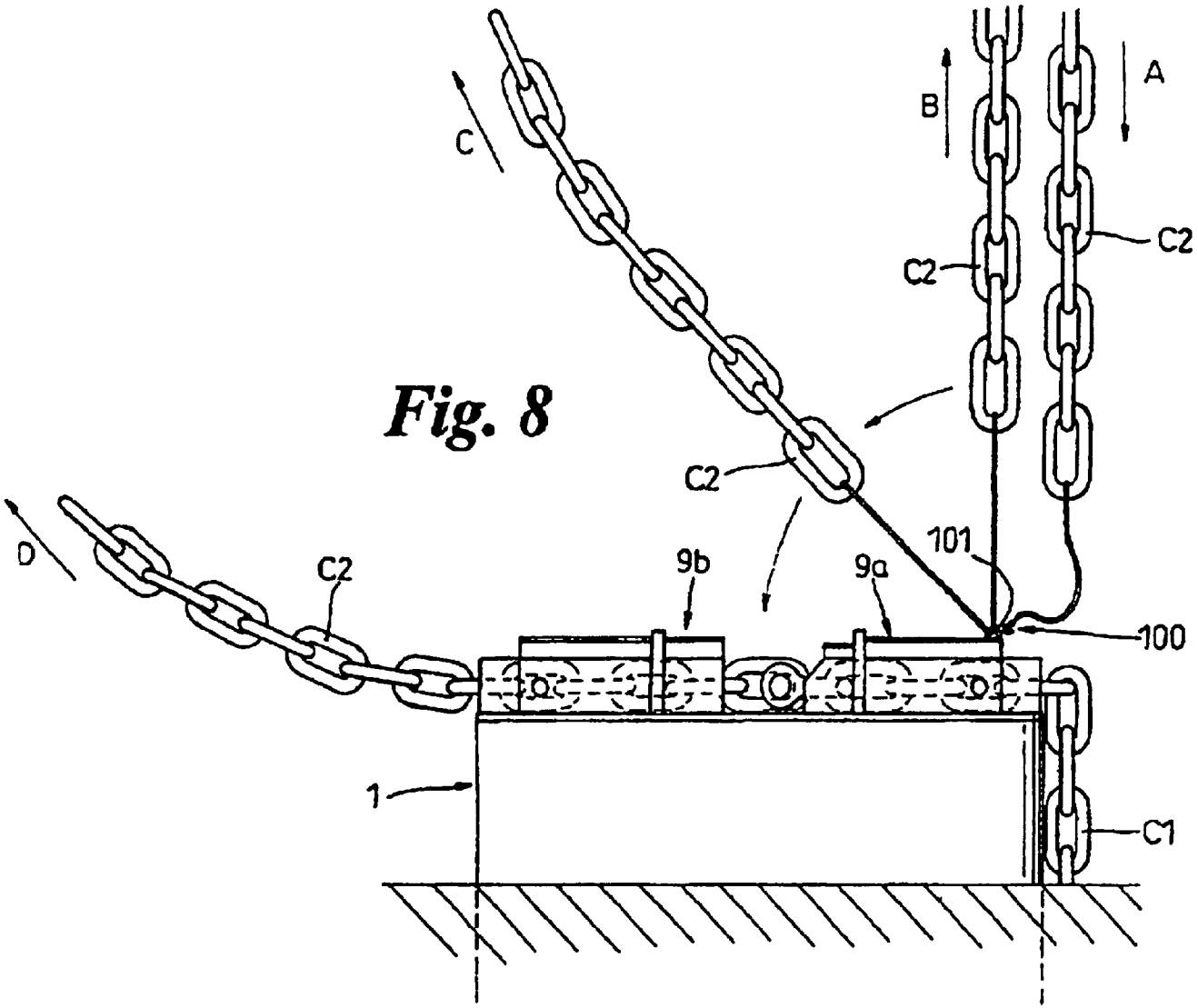

Once the anchor 1 has been deployed a heavy mooring chain C2 can be connected to the shackle on the chain C1. The steps involved in this operation are shown in FIGS. 6 and 8 of the drawings. FIG. 6 shows the chain C2 being lowered to the anchor 1 while FIG. 8 shows in greater detail the chain C2 at various stages during the fitting operation.

The upper end of the chain C2 is already connected to the production vessel P. The chain C2 is lowered into the water by a lifting barge (not shown) (see position A of FIG. 8). A guide hook and wire 100 are secured to the last or lowermost link of the chain C2 and an ROV is used to collect the guide hook and wire 100 and attach it to eyelets 101 on the upper surfaces of the side walls of the funnel 9*a*. The guide hook and wire 100 have been set to a predetermined length, so that the distance of the last link in the chain C2 is correctly set (see position B of FIG. 8).

The chain C2 is further lowered, with the lifting vessel stationed to the left-hand side, the tension in the chain C2 keeping the guide wire 100 extended (see position C of FIG. 8). The lowering of the chain is carefully controlled so that the end link of the chain C2 will be correctly disposed in the funnel 9*b* and the third link, the second vertical link, locates between the end plates 96 of the funnel 9*b* (see position D of FIG. 8). The weight of the chains involved with these operations even in the sea mean that the ROVs can provide no help except guidance and very minor positional adjustment, the major part of the lift and the control comes form the lifting equipment on the lifting barge.

When chain C2 is correctly located in the funnel 9*b* with its end link vertically disposed between the eyes of the shackle on the chain C1, the ROV is used to locate a pin 101 through the eyes of the shackle and the end link of the chain C2. When the pin 101 has been located and secured the connected mooring chain C may be lifted clear of the chain guiding means and deployed.

Figure 9:
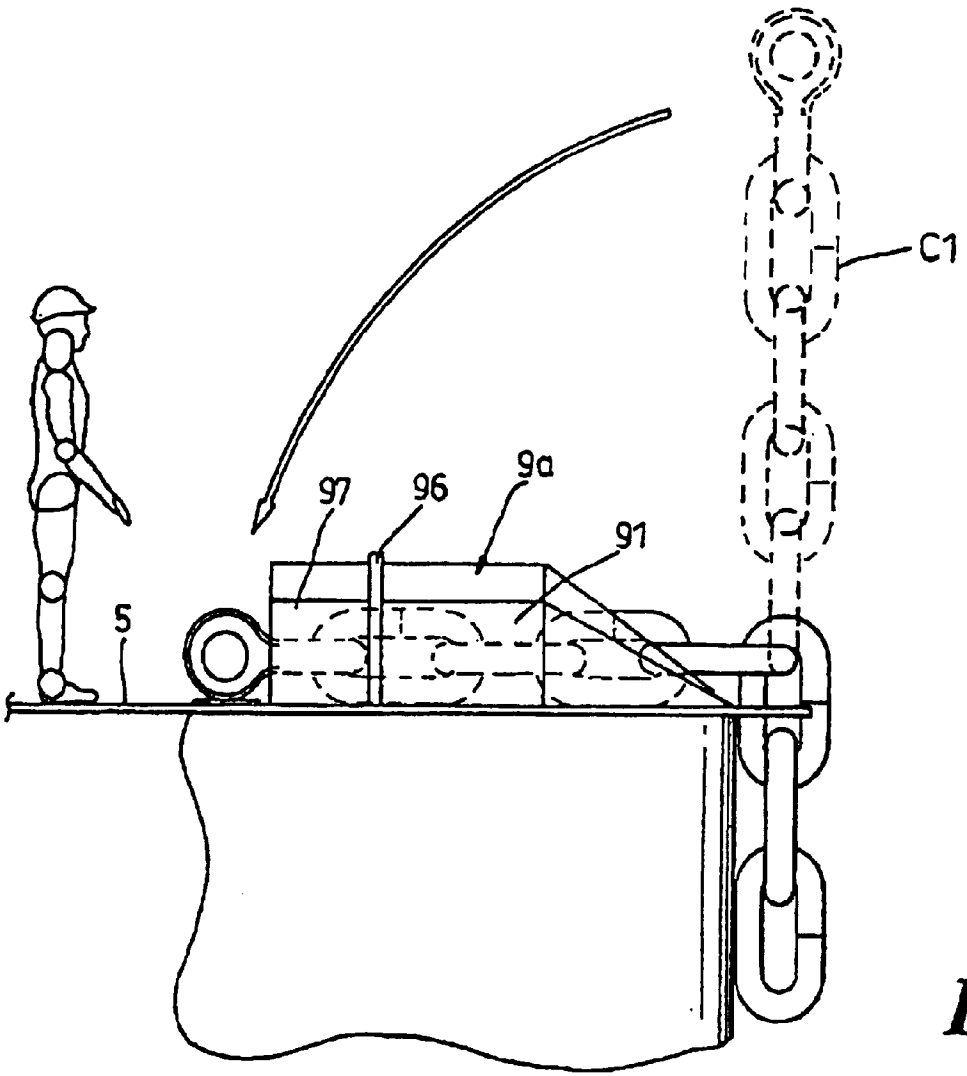
FIG. 9 shows an alternative anchor arrangement.

FIG. 9 of the drawings shows an alternative arrangement for funnel 9*a* as adapted for accepting a chain end with a shackle fitted. This arrangement of the funnel 9*a* is very similar to that described above and like numbers have been used to describe like components. This arrangement differs in that the end of the funnel 9*a* adjacent the edge of the top surface 5 is tapered.

In the case of drag embedment anchors, which do not have a convenient top surface for mounting the chain locators, the chain locating means may for example be provided on a "mud mat".

In another variation, the locating means may be provided separately from the anchor, or detachable from it. Such locating means may be provided on installations other than anchors, within the scope of the present invention, and may be reversible, for example to facilitate deployment and lifting of heavy modules. In each case, is provided means for guiding and locating the heavy chain or other tether to a position where it can be connected to the seabed installation. The seabed installation may or may not include the short chain or other tether, permanently attached for connection to the main tether.

What is claimed is:

1. A method of mooring using at least one anchor, wherein said anchor is first deployed to the seabed and a main tether is subsequently connected to the anchor to form a mooring, the method comprising:

providing the anchor with tether locating means positioned so as to be accessible after deployment of the anchor;

fitting a short first flexible tether section to the anchor so that one end is permanently connected to the anchor and the other end is temporarily located in said tether locating means;

deploying the anchor to the seabed;

lowering to the anchor a free end of said main tether;

positioning said free end of said main tether in said tether locating means;

interconnecting said temporarily located end of said first flexible tether section and said free end of said main tether; and lifting said interconnected tether sections clear of said tether locating means.

2. A method of mooring as claimed in claim 1, wherein the point of permanent connection to the anchor becomes buried once the anchor is fully deployed.

3. A method of mooring as claimed in claim 1, wherein said step of positioning said free end of said main tether in said tether locating means includes temporary attachment of a relatively lightweight guide tether between the free end of the main tether and a point on the anchor, the guide tether being dimensioned so that, as the main tether is lowered into position under tension in a predetermined direction, the free end of the main tether correctly locates in the tether locating means under its own weight.

4. A method of mooring as claimed in claim 1, wherein said temporarily located end of said first tether section comprises a shackle.

5. A method of mooring as claimed in claim 1, wherein said free end of said main tether comprises a shackle.

6. A method of mooring as claimed in claim 4, wherein said temporarily located end of said first tether section and said free end of said main tether are interconnected by a pin passed through both the shackle and the other of said tether sections.

7. A method of mooring as claimed in claim 1, wherein said anchor is a suction anchor and the method includes creating a partial vacuum inside the anchor by which it buries itself in the seabed.

8. A method of mooring as claimed in claim 1, wherein said first and main tethers comprise respective lengths of chain.

9. An anchor suitable for use in the method of mooring as claimed in claim 3, said anchor comprising:

means located on said anchor at a first point of attachment for permanently attaching a tether to the anchor;

tether locating means positioned on said anchor so as to be accessible after deployment of the anchor to the seabed; and a further point of attachment located on the anchor for at least one guide tether, said further point of attachment being spaced apart from said tether location means.

10. An anchor as claimed in claim 9, wherein said means for permanently attaching said tether comprises an eye attached to the side of the anchor for receiving a pin or bolt to secure the tether in place.

11. An anchor as claimed in claim 9, wherein said anchor is a suction anchor which can be caused to bury itself in the seabed by creating a partial vacuum inside the anchor.

12. An anchor as claimed in claim 9, wherein said tether locating means comprises two locating means each comprising a pair of upstands which in combination define a channel, each respectively arranged to accommodate free ends of said tethers being interconnected and to correctly locate and align said free ends, for subsequent interconnection.

13. An anchor as claimed in claim 12, wherein said channel includes a restricted section for locating and orienting a chain link.

14. An anchor as claimed in claim 9, wherein said anchor comprises a vessel having an open bottom end and a closed top end defining a top surface, and said means for attaching the tether to the anchor is on one side of the vessel where it will be buried during deployment of the anchor, wherein the tether locating means is located on said top surface so that the one end is positioned to vertically align with the means for attaching the tether to the anchor.

15. An anchor as claimed in claim 9, wherein said tether locating means is removably fitted to the anchor.

16. An anchor as claimed in claim 9, wherein said anchor further includes a short flexible tether section having a first end fitted to the means for permanently attaching said tether to the anchor, and a second end being located in the tether locating means.

17. An anchor as claimed in claim 16, wherein said short tether section comprises a length of chain.

18. A method of connecting a main tether to an article already located on the seabed, the method comprising:

providing the article with points of attachment for said main tether and at least one guide tether;

lowering to the article a free end of said main tether;

attaching at least one relatively lightweight guide tether(s) between the free end of said main tether and said guide tether attachment point(s) while the guide tether is not under tension;

lowering the main tether under tension in a predetermined direction, the length of the guide tether(s) under said tension being such that as the main tether is lowered, the free end of the main tether is constrained to locate correctly under its own weight, aligned with said main tether attachment point; and connecting the free end of said main tether to said main tether attachment point.

19. A method as claimed in claim 18, wherein there are provided two guide tethers attached to respective attachment points spaced horizontally so as to constrain the free end of the main tether to move in a known arc, under a range of tension directions.

20. A method as claimed in claim 18, further comprising as preliminary steps:

providing a tether locating means positioned so as to be accessible after deployment of the article, fitting a short tether section to the article so that one end is permanently connected to the article and a free end is temporarily located in said tether locating means and serves as said main tether attachment point, the method further comprising the step of:

lifting the interconnected main tether and short tether section clear of said tether locating means and into an operational configuration.

21. A method as claimed in claim 20, wherein the tether locating means and the short tether section are provided on the article after it is deployed to the seabed.

22. A method as claimed in claim 20, comprising as a preliminary step deploying the article to the seabed with the tether locating means and, where provided, the short tether section already attached to the article.

23. A method as claimed in claim 22, wherein the point of permanent connection of the short tether section to the article is buried, while its free end remains accessible in said tether locating means.

24. A method as claimed in claim 18, wherein said free end of said main tether comprises a shackle.

25. A method as claimed in claim 24, wherein said main tether attachment point and said free end of said main tether are interconnected by a pin passed through both the shackle and the attachment point.

26. A method as claimed in claim 18, wherein said main tether comprises a length of chain.

27. A method as claimed in claim 18, wherein said article is an anchor.

28. A method as claimed in claim 27, wherein said anchor is a suction anchor and the method includes creating a partial vacuum inside the anchor by which it buries itself in the seabed.

29. A method as claimed in claim 18, wherein said guide tether is attached to the free end of the main tether prior to lowering.

30. An article suitable for use with the method of connecting as claimed in claim 18, said article having an attachment point for attaching a main tether to the article, said main tether attachment point being positioned so as to be accessible after deployment of the article to the seabed, the article further being provided with at least one guide tether attachment point for use in the manner claimed in said claim.

31. An article as claimed in claim 30 wherein there are provided two guide tether attachment points, spaced horizontally apart from one another and from said main tether attachment point.

32. An article as claimed in claim 30 wherein said article is further provided with tether locating means for the alignment and temporary location of the free end of a main tether with said tether attachment point.

* * * * *

UNITED STATES PATENT AND TRADEMARK OFFICE

CERTIFICATE OF CORRECTION

PATENT NO. : 6,851,895 B2
DATED : February 8, 2005
INVENTOR(S) : Gutierrez et al.

It is certified that error appears in the above-identified patent and that said Letters Patent is hereby corrected as shown below:

Title page,
Item [75], Inventors, should read as follows:
-- Olivier Jarry, Cormeilles en Parisis (FR);
Lionel Storai, Marseilles (FR);
Olivier Gutierrez, Courbevoie (FR) --

Signed and Sealed this

Twenty-fourth Day of May, 2005

JON W. DUDAS
*Director of the United States Patent and Trademark Office*